United States Patent [19]

Takai

[11] 4,316,358

[45] Feb. 23, 1982

[54] FALSE-TWISTING SYSTEM

[75] Inventor: Isao Takai, Komatsu, Japan

[73] Assignee: Oda Gosen Kogyo Kabushiki Kaisha, Komatsu, Japan

[21] Appl. No.: 78,736

[22] Filed: Sep. 25, 1979

[30] Foreign Application Priority Data

Oct. 5, 1978 [JP] Japan ..... 53-122046

[51] Int. Cl.[3] ..... D02G 1/02

[52] U.S. Cl. ..... 57/286; 57/295; 118/234; 118/420; 118/DIG. 19

[58] Field of Search ..... 57/284, 286, 292, 295–298; 118/DIG. 19, DIG. 20, DIG. 22, 234, 258, 420

[56] References Cited

U.S. PATENT DOCUMENTS

| | | | |
|---|---|---|---|
| 1,959,723 | 5/1934 | Lejeune et al. | 57/298 X |
| 2,123,235 | 7/1938 | Dreyfus | 57/292 |
| 2,351,110 | 6/1944 | Davidson et al. | 118/DIG. 19 |
| 2,413,413 | 12/1946 | McDermott et al. | 118/DIG. 19 |
| 2,634,596 | 4/1953 | Pendleton et al. | 118/DIG. 19 |
| 2,723,215 | 11/1955 | Biefeld et al. | 118/DIG. 20 |
| 2,835,221 | 5/1958 | Slayter et al. | 118/DIG. 20 |
| 2,863,280 | 12/1958 | Ubbelohde | 57/284 |
| 2,899,796 | 8/1959 | Soussloff et al. | 57/286 |
| 3,085,389 | 4/1963 | Wegener et al. | 57/286 |
| 3,333,409 | 8/1967 | Servage | 57/286 |
| 3,348,368 | 10/1967 | Dudzik et al. | 57/286 |
| 3,434,277 | 3/1969 | Maeda et al. | 57/286 |
| 4,115,985 | 9/1978 | Venot | 57/286 |

*Primary Examiner*—John Petrakes

*Attorney, Agent, or Firm*—David G, Alexander

[57] ABSTRACT

A system for preparing a composite crimped filament (2) using a nipping type false-twisting apparatus (7) which has two endless intercrossing belts (13), (16) whose working surfaces are urged against each other in their intercrossing region (17) to nip the filament yarns (2) therebetween. A liquid is applied to the yarns (2) upstream of the false twister (7) to reduce friction and heat.

1 Claim, 7 Drawing Figures

FALSE-TWISTING SYSTEM

BACKGROUND OF THE INVENTION

The present invention relates to false-twisting systems and, more particularly, to a false-twisting system furnished with a false twister of a type having intercrossing and interengaging endless belts.

One type of known false-twisting apparatus employs two endless belts which intercross each other to nip filament yarns therebetween, as disclosed for example in U.S. Pat. No. 3,045,416. The endless belts of this type of apparatus are spaced slightly away from each other to avoid wear of the working surfaces of the belts. Another type of false twister is proposed in my U.S. Pat. No. 4,047,373 in which two intercrossing endless belts each having a small coefficient of friction are urged in surface-to-surface relation against each other to nip and false-twist filament yarns therebetween. However, such a false twister using interengaging endless belts involves a certain degree of wear of the belts and generation of heat. Particularly, an increase in the contact or nipping pressure between the belts produces an increase in the temperature of the belts due to friction, so that heat-setting provided to false-twisted filament yarns tends to be removed and/or the belt surfaces tend to smoke end be damaged. Though permitting a considerable velocity of yarn feed, the false twister of the second-mentioned type needs a disproportionately long cooling zone to cope with such a yarn velocity.

SUMMARY OF THE INVENTION

An object of the present invention is to provide a false-twisting system which performs false-twisting of filament yarns while providing lubrication to avoid temperature elevation of intercrossing endless belts.

Another object of the present invention is to provide an apparatus for supplying a liquid to working surfaces of intercrossing endless belts.

A further object of the present invention is to provide a false-twisting system equipped with an apparatus which cools filament yarns in a short distance of travel of the yarns.

In one aspect of the present invention, there is provided a false-twisting system which comprises yarn feeding means, a heating unit, a friction type false-twisting apparatus having intercrossing and interengaging endless belts, and means located upstream of the false twister to apply a liquid to filament yarns.

In another aspect of the present invention, there is provided an apparatus which includes a pipe whose wall is partly cut away so that filament yarns may pass through the cut away portion of the pipe and thereby be applied with liquid.

DESCRIPTION OF THE PREFERRED EMBODIMENTS

Figure 1:
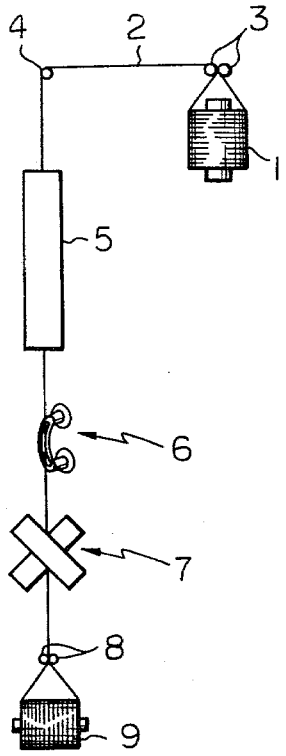
FIG. 1 schematically illustrates a false-twisting system according to the present invention.

A false-twisting system according to the present invention is generally illustrated in FIG. 1. As shown, filament yarns 2 fed from a bobbin 1 advance through guide rollers 3 and 4 to a heating unit 5 wherefrom they are passed to a liquid applier apparatus 6 for depositing water, water-soluble oil or like liquid on the yarns 2 for the purposes which will be discussed later. The filament yarns 2 now wet with the liquid further advance to a friction type false-twisting apparatus 7 which performs false-twisting of the filament yarns. From the false twister 7, the processed composite filament yarn is fed to and wound on a take-up unit 9.

Figure 2:
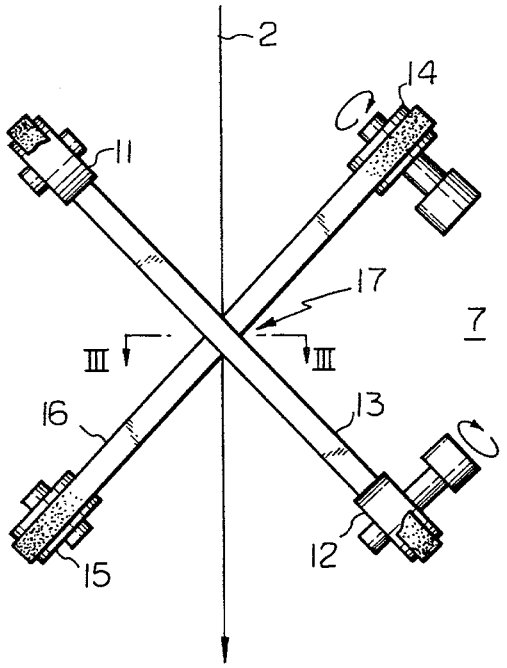
FIG. 2 shows a false-twisting apparatus employing intercrossing, interengaged endless belts.
Figure 3:
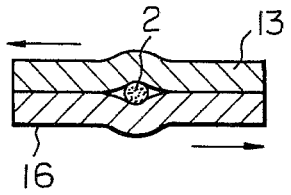
FIG. 3 is a section taken along a line III—III of FIG. 2.

Details of the false-twisting apparatus 7 are depicted in FIG. 2. The false twister 7 is comprised of a first endless flat surfaced belt 13 trained around operating pulleys 11 and 12 and a second endless flat surfaced belt 16 trained around pulleys 14 and 15. The belts 13 and 16 cross each other at a suitable angle $\theta$ and are engaged in surface-to-surface relation with each other in the intercrossing area designated 17 as viewed in FIG. 3. The filament yarns 2 travelling through the intercrossing area 17 are applied not only with a twisting action but with an advancing action in accordance with the movement of the belts 13 and 16.

Figure 4:
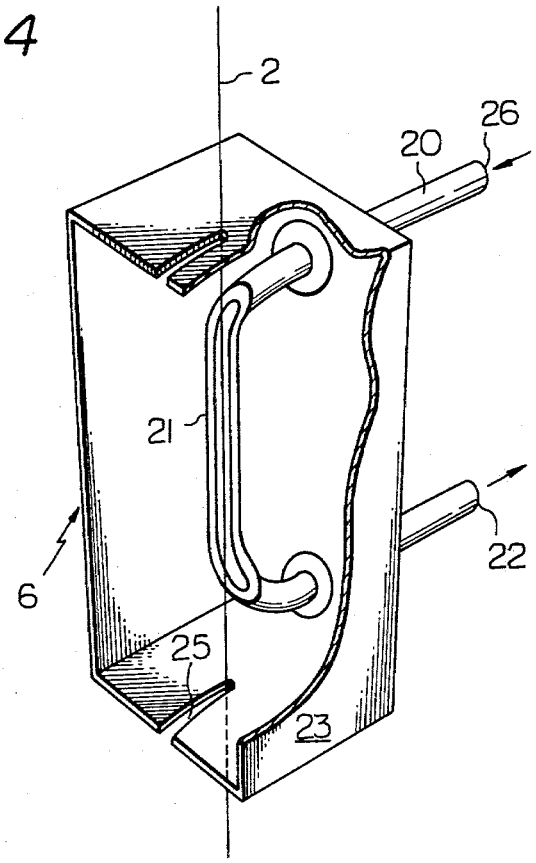
FIG. 4 is a perspective view of an apparatus for applying liquid to filament yarns.

Referring to FIG. 4, there is shown an example of the liquid applier 6 which employs a generally U-shaped pipe 20 and a casing 23. The U-shaped pipe 20 is mounted to the casing 23 in such a manner as to have its base portion 21 oriented vertically. As illustrated, the bottom or outer part of the wall of the base portion 21 is cut away or removed while the casing 23 is formed with vertically aligned upper and lower slits 24 and 25.

A liquid as typified by water or water-coluble oil is supplied at a small rate from an upper end or inlet 26 of the pipe 20 so that it flows down along the inner/surface of the pipe 20 and then out of the pipe 20 through a lower end or outlet 22. Meanwhile, the filament yarns 2 enter the casing 23 through the upper slit 24 and exit through the lower slit 25 passing through the cut away wall of the base 21. Consequently, the filament yarns 2 are applied with liquid in the course of travel through the pipe 20. The yarns 2 carry liquid to the false twister 7 and, when reaching the interface 17 between the crossing belts 13 and 16, wet the working surfaces of the belts 13 and 16 with liquid. The belts 13 and 16 are therefore advantageously lubricated and cooled at the same time. Furthermore, the filament yarns 2 themselves are cooled by the liquid after being heated by the heating unit 5.

Though the liquid for lubrication and cooling may comprise either water or water-soluble oil, the use of water is preferable from the viewpoint of cost, etc.

Figure 5:
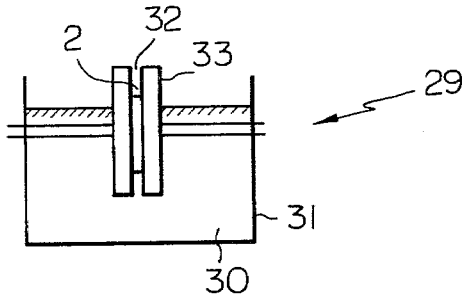
FIG. 5 is a schematic illustration of another liquid applier viewed from above.

Another example of a liquid applier for depositing liquid on the filament yarns 2 is illustrated in FIG. 5. A liquid applier 29 comprises a container 31 which holds a liquid 30. A roller 33 having a circumferential recess or groove 32 is journalled to the container 31 and is partially immersed in the liquid 30. The filament yarn 2 runs through the groove 32 of the rotating roller 33 to be applied with the liquid 30. It is to be noted that the rotating direction of the roller 33 is preferably, but not limitatively, opposite to the direction of travel of the yarns 2.

Figure 6:
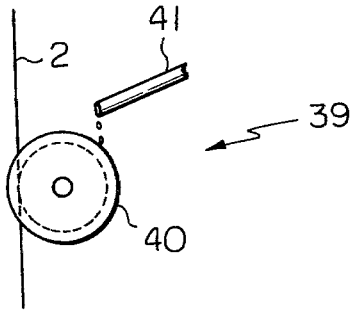
FIG. 6 shows still another liquid applier.

A further example of a liquid applier 39 is shown in FIG. 6 and employs a pipe 41 in combination with a roller 40 grooved in the same way as the roller 33 of FIG. 5. With this arrangement, droplets of liquid are caused to drop from the pipe 41 onto the roller 40 whose groove guides the filament yarns 2.

It will be apparent to those who are skilled in the art that various other systems are available for applying liquid to the filament yarns. For instance, the filament yarns may be guided into a container holding a liquid or passed through a liquid which is flowing downwardly.

Figure 7:
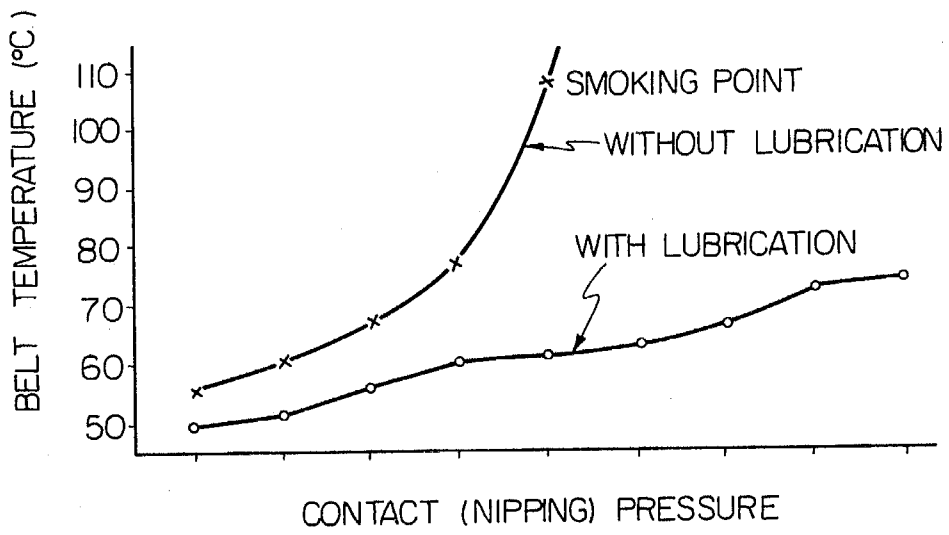
FIG. 7 shows curves presenting temperature variations of endless belts obtained with and without the supply of a liquid, respectively.

Curves shown in FIG. 7 present comparison between temperature variations of endless belts supplied with liquid as in the present invention and those of endless belts without the liquid application. The graph of FIG. 7 was plotted by moving the cooperating endless belts toward each other from a minimally engaged condition so as to progressively increase the contact or nipping pressure attributable to the tensions of the belts. The curve through the "O" marks was obtained by the application of liquid according to the invention whereas the curve through the "X" marks was obtained with no liquid applied.

As will now be appreciated with reference to FIG. 7, a false-twisting system according to the present invention permits the false twister to endure a long period of continuous operation stably even under conditions which, using conventional systems, would damage endless belts of the false twister due to generation of heat.

What is claimed is:

1. A false-twisting system, comprising means for feeding, filament yarns, a heating unit, a false-twisting apparatus disposed below the heating unit having two endless belts which intercross each other and are urged into contact with each other and liquid applier means disposed between the heater means and the false-twisting apparatus for applying a liquid to the filament yarns;

the liquid applier means including a pipe which has a wall thereof partly cut away, the liquid flowing through the pipe and the yarns passing through the cut away wall;

the pipe being substantially U-shaped and having a base portion thereof oreinted vertically, part of the wall of the base portion being cut away, the system further comprising means for guiding the filament yarns vertically downwardly through only the cut away wall of the base portion of the pipe and thereby through the liquid flowing therethrough.

* * * * *